US007478505B2

(12) United States Patent
Frobosilo

(10) Patent No.: US 7,478,505 B2
(45) Date of Patent: Jan. 20, 2009

(54) METAL STUD ARRANGEMENT

(76) Inventor: Raymond C. Frobosilo, 8-01 26th Ave., Astoria, NY (US) 11102

( * ) Notice: Subject to any disclaimer, the term of this patent is extended or adjusted under 35 U.S.C. 154(b) by 422 days.

(21) Appl. No.: 11/286,067

(22) Filed: Nov. 23, 2005

(65) Prior Publication Data

US 2007/0125026 A1 Jun. 7, 2007

(51) Int. Cl.
*E04B 1/16* (2006.01)
*E04B 1/20* (2006.01)
*E04B 5/18* (2006.01)

(52) U.S. Cl. ..... 52/331; 52/481.1; 52/329

(58) Field of Classification Search ..... 52/241, 52/481.1, 329, 331, 632, 36.6; 403/329, 403/331, DIG. 4
See application file for complete search history.

(56) References Cited

U.S. PATENT DOCUMENTS 2,457,250 A * 12/1948 Macomber ..... 52/694
3,492,766 A * 2/1970 Andrews ..... 52/36.6
3,925,939 A * 12/1975 Costruba ..... 52/36.6
4,370,838 A * 2/1983 Vermillion ..... 52/36.6
4,397,127 A * 8/1983 Mieyal ..... 52/241
4,854,096 A * 8/1989 Smolik ..... 52/241
5,040,345 A 8/1991 Gilmour
5,394,665 A * 3/1995 Johnson ..... 52/241
5,628,598 A 5/1997 Hofle
5,655,344 A 8/1997 Moen et al.
5,685,121 A 11/1997 DeFrancesco et al.
5,927,038 A * 7/1999 Goldberg et al. ..... 52/632
6,119,430 A * 9/2000 Nicholls ..... 52/733.2
6,122,871 A 9/2000 Russell et al.
6,176,053 B1 * 1/2001 St. Germain ..... 52/232
6,929,226 B1 8/2005 Philistine
2003/0145537 A1 * 8/2003 Bailey ..... 52/210
2004/0003564 A1 * 1/2004 Surowiecki ..... 52/481.1

* cited by examiner

*Primary Examiner*—Richard E Chilcot, Jr.
*Assistant Examiner*—Chi Q Nguyen
(74) *Attorney, Agent, or Firm*—Notaro & Michalos P.C.

(57) ABSTRACT

A metal stud arrangement has a top track with a support rail fixed to the track-web and extending between track flanges into the trough of the track. The support rail has an enlarged hanger portion with a maximum width. A metal stud of the arrangement has an opening near the top end of the stud web for receiving the support rail, the opening having an entry passage with a width that is smaller than the maximum width of the hanger portion and the passage being adapted to receive the support rail. The opening includes an enlarged portion that is larger than the maximum width so that with the hanger portion in the enlarged portion of the opening, the stud hangs from the top track.

17 Claims, 6 Drawing Sheets

METAL STUD ARRANGEMENT

FIELD AND BACKGROUND OF THE INVENTION

The present invention relates generally to the field of building components, and in particular to a new and useful metal stud arrangement.

A wide variety of metal stud arrangements are known. See for example, U.S. Pat. No. 5,685,121 to Defrancesco et al; U.S. Pat. No. 5,040,345 to Gilmour; U.S. Pat. No. 6,929,226 to Philistine; U.S. Pat. No. 5,628,598 to Hoefle; U.S. Pat. No. 6,122,871 to Russell et al; and U.S. Pat. No. 5,655,344 to Moen et al.

These arrangements usually include top and bottom U-shaped tracks which receive metal studs that are also U-shaped in cross section. Often it is difficult to at least momentarily fix the studs in their respective positions in the top and bottom tracks, for example, on 16 inch centers. For this reason various clips and anchors have been developed for securing at least the top end of the stud in its top track. None of these systems are satisfactory, however, and few permit easy longitudinal movement of the stud along the top track. Such lateral movement is necessary, however, to line-up each stud when a gypsum board is to be fastened to the studs, for example, using screws. In particular, where a pair of gypsum boards meet, the stud must be placed to overlap the edges of both boards so that both can be screwed in place.

Another problem associated with metal studs is that if they cut exactly to the floor to ceiling length, they cannot accommodate movement, for example, downward movement of the ceiling or irregularities in the ceiling or floor. If a gypsum board is installed on such systems and the ceiling moves downwardly even slightly, for example, because of settling, the gypsum board will crack or its seams will open.

Accordingly, a need remains for a solution to the problems described above.

SUMMARY OF THE INVENTION

It is an object of the present invention to provide a metal stud arrangement comprising: a metal top track having a track web with opposite side edges and a pair of track flanges connected along the respective opposite side edges of the top track to form a downwardly facing trough; a support rail fixed to the track web, extending between the track flanges and into the trough, the support rail having an enlarged hanger portion spaced downwardly from the track web, the hanger portion having a maximum width in a direction extending between the track flanges; and a metal stud having a stud web with a top end, a pair of side edges and a stud flange connected along at least one of the side edges of the stud, the web including a support rail receiving opening near the top end of the stud web, the support rail receiving opening having an entry passage with a width that is smaller than the maximum width of the hanger portion, the passage being adapted to receive the support rail, the opening including an enlarged portion that is larger than the maximum width so that with the hanger portion in the enlarged portion of the support rail receiving opening, the stud hangs from the top track.

A further object of the invention is to provide such an arrangement where the stud includes a pair of stud flanged connected along the opposite side edges of the stud web, an outside dimension of the stud between the stud flanges being substantially equal to an inside dimension of the top track between the track flanges so that the top end of the stud sits movably in the trough when the stud web is substantially perpendicular to the track flanges.

A further object of the invention is to provide a metal stud arrangement which permits a single worker, without a ladder, to install studs which hang and permit vertical displacement between each stud and the top and bottom tracks and lateral movement along the tracks. Despite this freedom of movement each stud is held sufficiently securely in place to permit attachment of the gypsum boards.

Although any suitable metal can be used, it is contemplated that galvanized steel or steel which is otherwise coated to reduce rust be used. The metal forming the components of the invention can be bent to shape or formed to shape and made of single pieces or multiple pieces. In general, 30 to 12 gauge steel can be used or steel that is anywhere from about 0.015 to 0.096 inches in wall thickness. Steel or other metals outside this range are also appropriate for the invention depending on its application.

In general the present invention is particularly suited to non-bearing, interior walls, particularly in view of the vertical displacement permitted between the studs and their attached gypsum boards and the top and bottom tracks. Other applications of the invention may also be appropriate, however.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
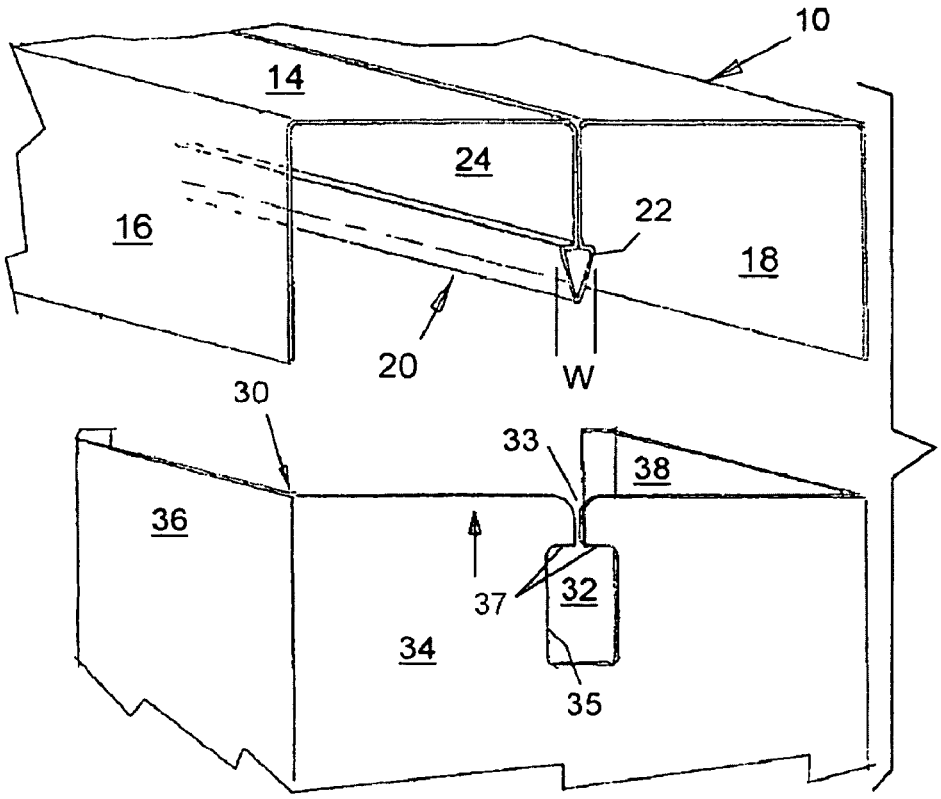
FIG. 2 is a perspective view of the arrangement.
Figure 4:
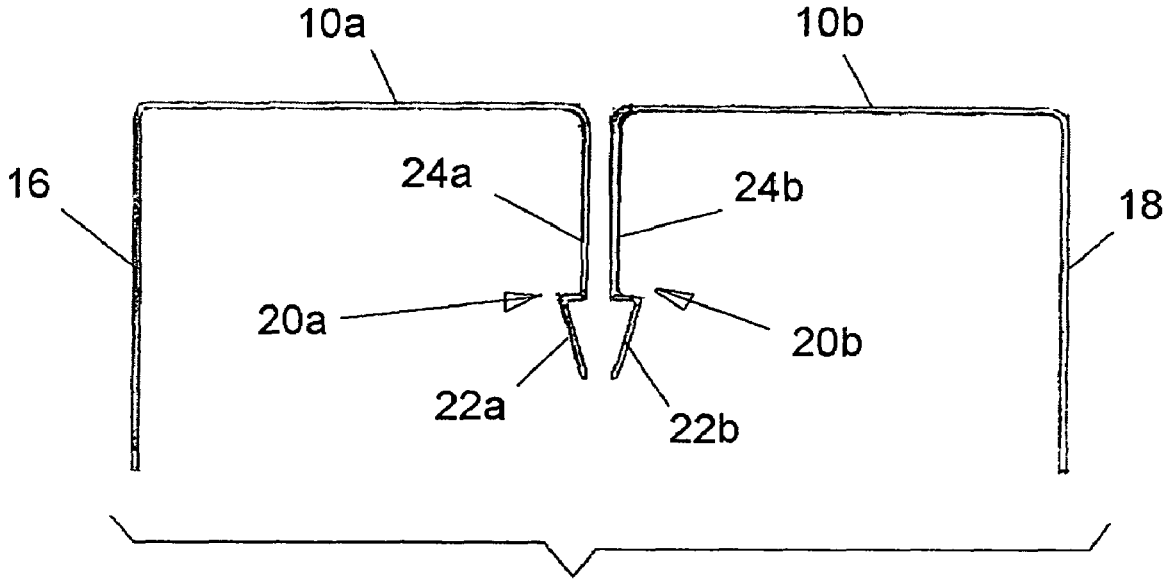
FIG. 4 is a side, exploded view of a multi-part embodiment of the top track of the invention.

Referring now to the drawings, in which like reference numerals are used to refer to the same or similar elements, FIG. 2 and shows the metal stud arrangement of the invention which includes a metal top track 10 having a track web 14 with opposite side edges and a pair of track flanges 16 and 18 connected along the respective opposite side edges of the top track to form a downwardly facing trough. A support rail 20 is fixed to the track web, extends between the track flanges and is at least partly or can be entirely in the trough. The support rail 20 has an enlarged hanger portion or elargement 22, spaced downwardly from the track web 14. Enlarged hanger portion 22 can, for example, be an enlargement of a support flange 24 formed as one piece with the web 14 and flanges 16, 28, or formed of separate pieces. FIG. 4, for example, illustrates a top track 10, formed of two symmetrical mirror image parts 10*a* and 10*b* that each have one of the flanges 16 or 18, and half or a portion of the track web 14*a* and 14*b*, as well as half or a portion of the support rail 20*a* and 20*b*. The two parts can be connected, e.g. by spot welding the support flanges 24*a* and 24*b* to each other. The lower converging edged of the enlargement halves 22*a* and 22*b*, may simply be brought close to each other when the flanges 24*a* and 24*b* are fixed to each other, as they will eventually be held in proper association with each other when they are inside a support rail receiving opening in the stud.

Returning to FIG. 2, the hanger portion 22, regardless of how it is made, has a maximum width W in a direction extending between the track flanges 16 and 18.

FIG. 2 also shows the arrangement of the invention to include a metal stud 30 having a stud web 34 with a top end illustrated in FIG. 2, a pair of side edges and one or two stud flanges 36 and 38 connected along at least one or preferably both of the side edges of the stud. The web 34 includes a support rail receiving opening 32 near the top end of the stud. This opening has an entry passage 33 with a width that is smaller than the maximum width W of the enlarged hanger portion 22 of the support rail 20. The passage is adapted to receive the support rail and the opening 32 includes an enlarged portion 35 that is large enough in width (i.e. at least as large as the maximum width W) and height, so that with the enlarged hanger portion 22 of the support rail received in the enlarged portion of the opening, the stud hangs from the top track 10.

Figure 3:
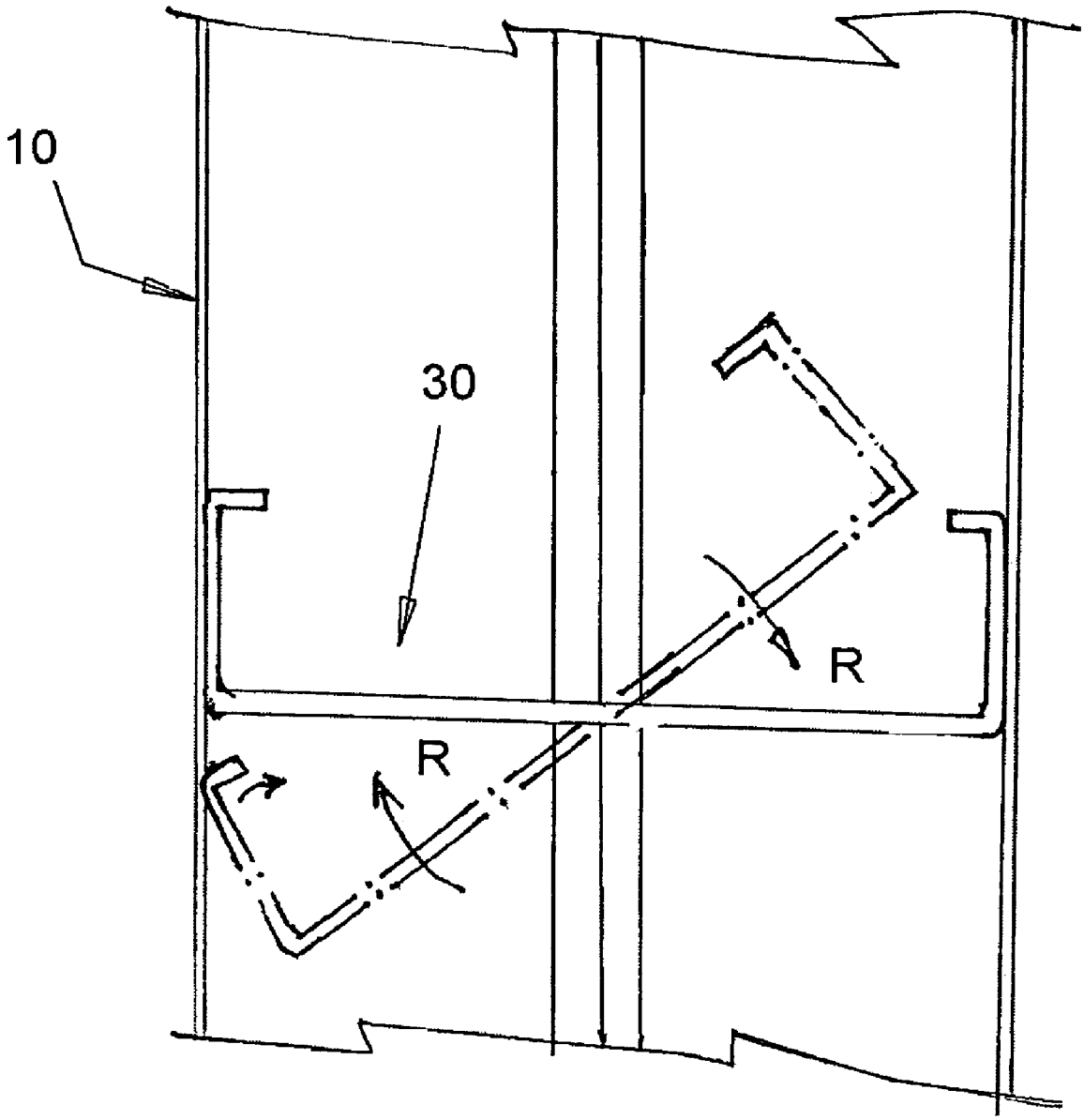
FIG. 3 is a plan view of the arrangement.

An outside dimension of the stud 30, between the stud flanges 36 and 38, is substantially equal to an inside dimension of the top track between the track flanges 16 and 18, so that the top end of the stud sits in, but is also movable in the trough, when the stub web is substantially perpendicular to the track flanges as shown in FIG. 3.

Figure 5:
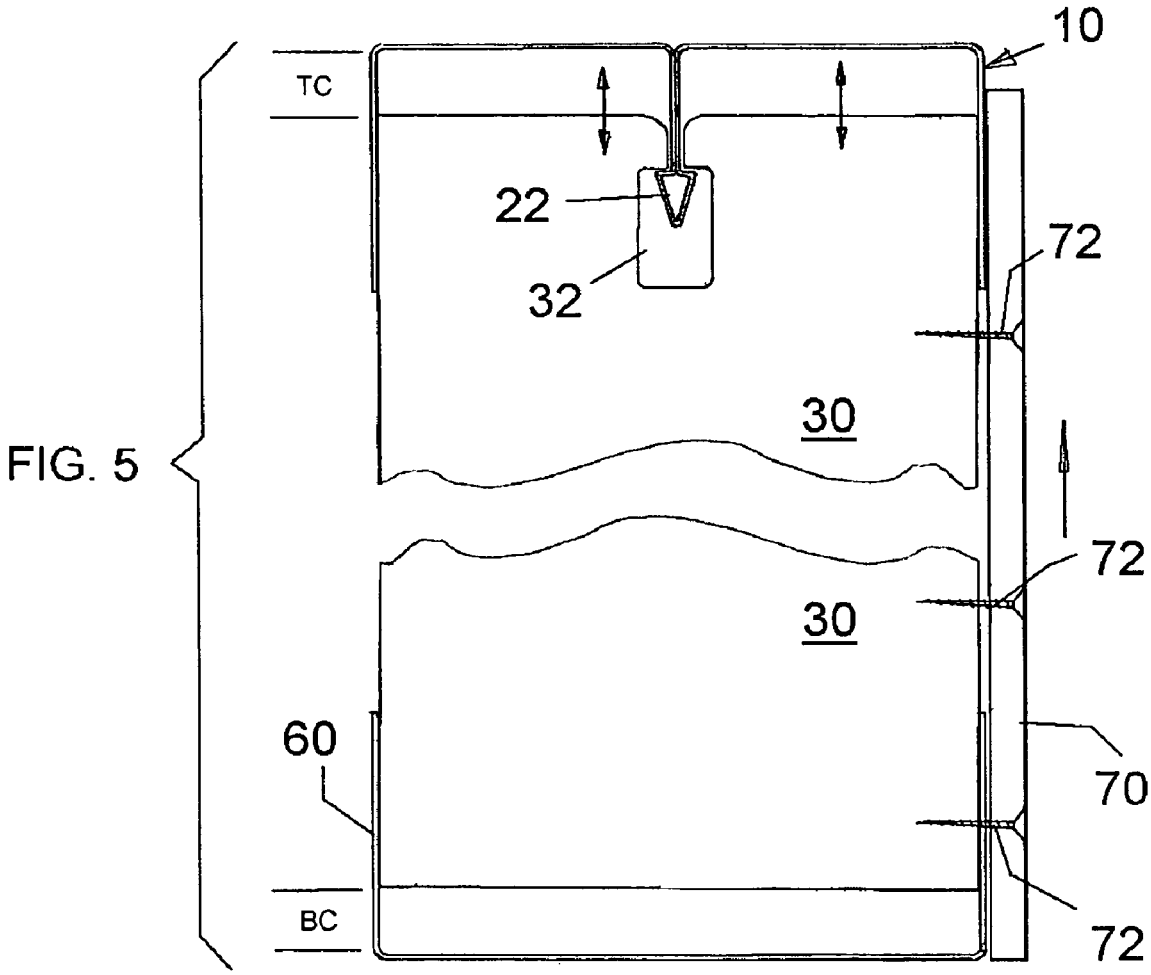
FIG. 5 is a side elevation of the arrangement to show how the hanging stud of the invention provides advantageous clearances.
Figure 6:
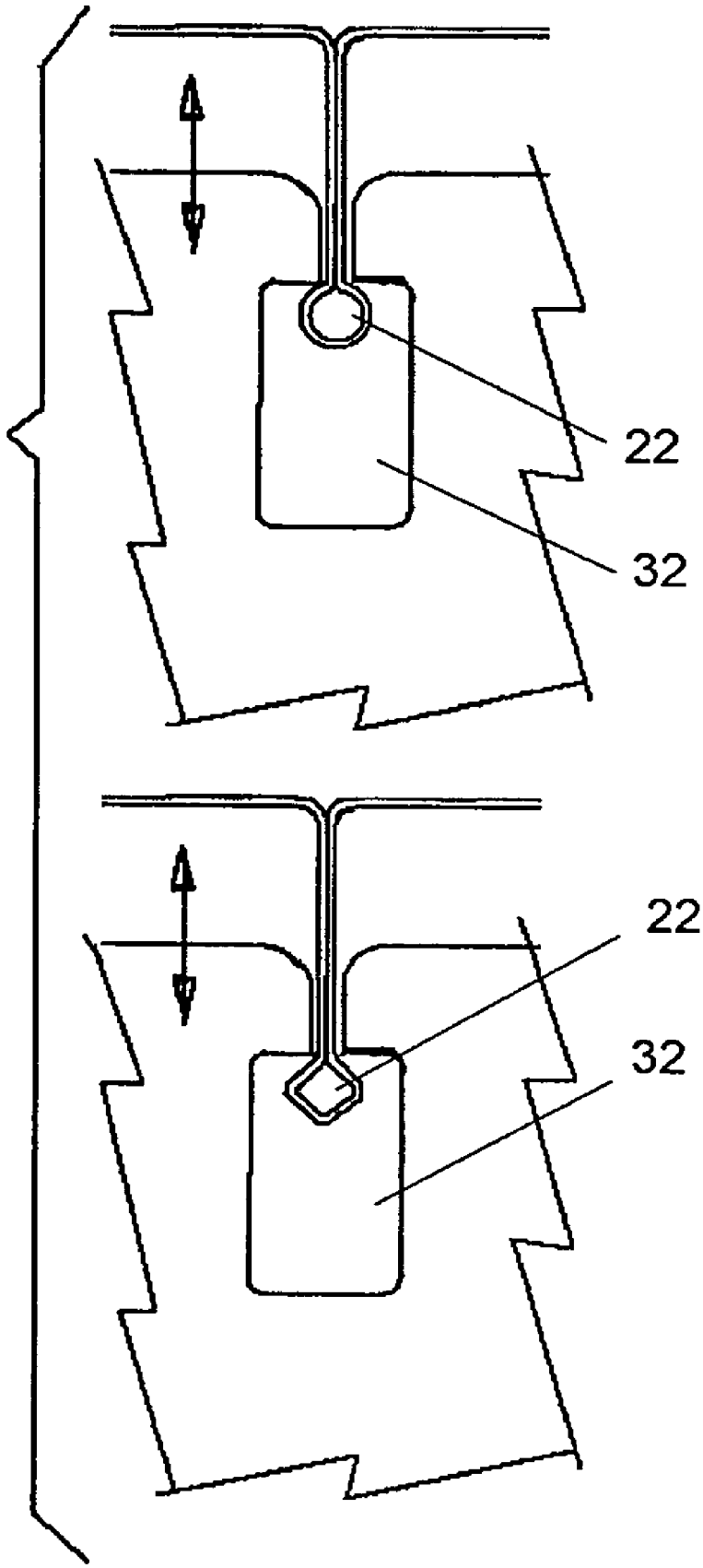
FIG. 6 is a composite view of alternate, non-limiting embodiments for the shape of the support rail enlargement and stub web opening.

It will be seen in FIGS. 2, 5, and 6, that the support rail receiving opening 32, in particular at the upper end of passage 33, is funnel shaped or tapers from a large dimension to a smaller dimension. This allows a funnel effect as the studs 30 are pushed up into the trough of the top track 10, rotated into position as will be explained in connection with FIG. 3, and allowed to fall into their hanging position illustrated in FIG. 5.

To achieve this hanging effect, at the top of the enlarged portion 35 of the opening 32, and on opposite sides of the passage 33, a shoulder 37 is provided. Each shoulder 37 is advantageously horizontal or at least substantially transverse to insure a proper support on the enlarged hanger portion 22 of the support rail 20.

Turning to FIG. 3, the invention is practiced by first attaching the top track 10 to the ceiling surface or ceiling joists or beams designed to carry the track. Each stud is then held with its opening 32 up and the entry of the passage 33 (see FIG. 2) is raised so that it begins to receive the enlarged hanger portion 22 of the support rail 20. Although the support rail 20 and the associated opening 32 are shown at the center of the respective track 10 and stud 30, and this is the preferred position, the rail and associated opening can be off-center. The central position is advantageous since it allows the studs to be installed with their flanges extending in either direction. If it is important that the side flanges 36 and 38 of each stud 30 face the same direction, then it may be advantageous to provide off-center rail and openings to ensure the proper positioning of each stud.

In any case when the stud is lifted into place and the enlargement 22 is well inside the enlarged portion 35 of opening 32, the stud is rotated in the direction of arrows R-R, in FIG. 3 and, in effect, snapped into place. The transverse final position of each stud is shown in solid line in FIG. 2 with the rotating position in phantom line. Some slight deformation of one or both flanges of the stud are permitted to accommodate this rotation and to ensure a snug fit of the stud flanges inside the track flanges. This installation can be done by one person and without a ladder.

FIG. 5 shows that after the stud has been rotated into place it can be allowed to drop or pulled down in the direction of the vertically extending double arrows. This also provides a top clearance TC between the top edge of each stud and the inside surface of the track web. A clearance BC can also be provided at the bottom between the bottom edge of the stud 30 and a bottom track 60. In this way a shorter stud than the wall height is used and clearance is available for uneven ceilings and settling.

A piece of gypsum board 70 is then put into place. While the bottom edge of the board can rest on the floor, its top edge should be spaced below the ceiling surface to take advantage of the vertical movement permitted between the stud 30 and the top track 10. Fasteners such as screws 72 are then used to attach the board to the stud 30, and the bottom screw may also pass through the bottom track or channel flange 60. It is important that the top screw 72 not pass through the flange of the top track 10, however, to make sure that the gypsum can still rise in the direction of the upwardly facing arrow in FIG. 5. Such relative movement between the stud and track may be necessary to accommodate irregularities in the ceiling or even downward movement of the ceiling due to settling of the building. This will effectively avoid cracking of the gypsum board.

Figure 1:
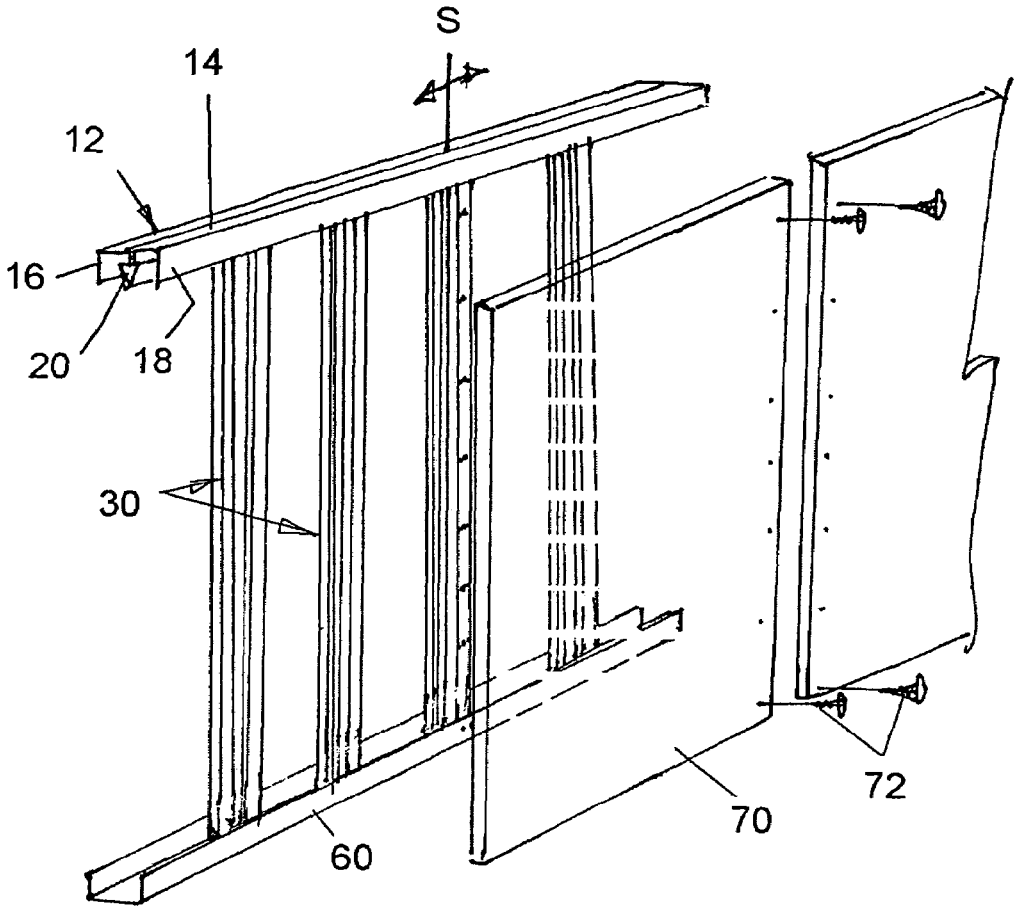
FIG. 1 is a perspective view of a metal stud arrangement according to the present invention and including examples of gypsum board to be fastened to the arrangement.

FIG. 1 also illustrates the use of fasteners or screws 72 to attach adjacent edges of gypsum boards 72 to a single stud. The invention permits lateral movement of the stud in the direction of arrow S in FIG. 1, to line up each stud with the mating edges of the boards or otherwise properly place each stud.

As it is known in the prior art, the stud web can also include other openings for electrical lines, plumbing and the like, and these are not illustrated in the drawings as they are known in the prior art. This insertion step also contemplates some defection of the stud web material around the opening 32, the metal material around being resilient to spring back into place.

FIG. 6 shows that the enlargement 22 of the support rail need not be in the shape of a downwardly directed arrowhead as in FIGS. 2, 4, and 5, but maybe other shapes such as cylindrical or oval in the upper part of FIG. 6, or diamond-shaped in the lower part of FIG. 6. Any other enlarged shape is also acceptable as long as the shape of the passage 33 in the opening of 32 of each stud web is shaped so that it can be pushed up to bring the support rail enlargement into the enlargement of the opening.

While specific embodiments of the invention have been shown and described in detail to illustrate the application of the principles of the invention, it will be understood that the invention may be embodied otherwise without departing from such principles.

What is claimed is:

1. A metal stud arrangement system comprising:

a metal bottom track having a bottom track web with opposite side edges and a pair of bottom track flanges connected along the respective opposite side edges of the bottom track to form an upwardly facing trough:

a metal top track having a top track web with opposite side edges and a pair of track top flanges connected along the respective opposite side edges of the top track to form a downwardly facing trough;

a support rail fixed to the top track web, extending between the top track flanges and into the downwardly facing trough, the support rail having an enlarged hanger portion spaced downwardly from the top track web, the hanger portion having a maximum width in a direction extending between the top track flanges; and a non-bearing metal stud having a stud web with a top end, a bottom end, a pair of side edges and a stud flange connected along at least one of the side edges of the stud, the web including a support rail receiving opening near the top end of the stud web, the support rail receiving opening having an upper entry passage with a width that is smaller than the maximum width of the enlarged hanger portion, the upper entry passage being adapted to receive the support rail, the opening including an enlarged portion that is larger than the maximum width of the enlarged hanger portion so that with the hanger portion in the enlarged portion of the support rail receiving opening, the stud hangs from the top track with a top clearance between the top end of the stud and the top track web, and a bottom clearance between the bottom end of the stud and the bottom track web, for allowing vertical displacement of the stud between the top and bottom track webs.

2. The metal stud arrangement system according to claims 1, wherein the stud includes a pair of stud flanges connected along the opposite side edges of the stud web, an outside dimension of the stud between the stud flanges being substantially equal to an inside dimension of the top track between the top track flanges so that the top end of the stud sits movably in the downwardly facing trough when the stub web is substantially perpendicular to the top track flanges.

3. The metal stud arrangement system according to claim 1, wherein the upper entry passage of the opening in the stud web has a downwardly tapering shape to help introduce the support rail enlarged portion into the stud web opening.

4. The metal arrangement system according to claim 1, wherein an enlarged portion of the opening includes a shoulder on each side of the upper entry passage as it meets the enlarged portion.

5. The stud arrangement system according to claim 1, wherein the length of the upper entry passage is selected and the size of the enlarged portion of the opening is selected with respect to the length of the support rail to allow relative upward movement between the stud and the top track.

6. The metal stud arrangement system according to claim 1, wherein the shape of the enlarged portion of the support rail, in cross-section is an arrow head.

7. The metal stud arrangement system according to claim 1, wherein the shape of the enlarged hanger portion of the support rail, in cross-section is selected from the group consisting of: oval and circular.

8. The metal stud arrangement system according to claim 1, wherein the shape of the enlarged portion of the support rail, in cross-section is diamond shaped.

9. The metal stud arrangement system according to claim 1, wherein the stud is made of metal having a thickness of from 0.015 to 0.096inches.

10. The metal stud arrangement system according to claim 1, wherein the middle of the stud is galvanized coated to reduce rusting of the stud.

11. The metal stud arrangement system according to claim 1, wherein the top track is made of one piece of bent metal material.

12. The metal stud arrangement system according to claim 1, wherein the top track is made of at least two pieces of material which are fixed to each other.

13. A metal stud arrangement system comprising:

a metal bottom track having a bottom track web with opposite side edges and a pair of bottom track flanges connected along the respective opposite side edges of the bottom track to form an upwardly facing trough:

a metal top track having a top track web with opposite side edges and a pair of top track flanges connected along the respective opposite side edges of the top track to form a downwardly facing trough;

a support rail fixed to the track web, extending between the top track flanges and into the downwardly facing trough, the support rail having an enlarged hanger portion spaced downwardly from the top track web, the hanger portion having a maximum width in a direction extending between the top track flanges; and a non-bearing metal stud having a stud web with a top end, a bottom end, a pair of side edges and a stud flange connected along at least one of the side edges of the stud, the web including a support rail receiving opening near the top end of the stud web, the support rail receiving opening having an upper entry passage with a width that is smaller than the maximum width of the enlarged hanger portion, the upper entry passage being adapted to receive the support rail, the opening including an enlarged portion that is larger than the maximum width of the enlarged hanger portion so that with the enlarged hanger portion in the enlarged portion of the support rail receiving opening, the stud hangs from the top track with a top clearance between the top end of the stud and the top track web, and a bottom clearance between the bottom end of the stud and the bottom track web, for allowing vertical displacement of the stud between the top and bottom track webs;

the stud including a pair of stud flanges connected along the opposite side edges of the stud web, an outside dimension of the stud between the stud flanges being substantially equal to an inside dimension of the top track between the top track flanges so that the top end of the stud sits movably in the trough when the stub web is substantially perpendicular to the top track flanges.

14. The metal stud arrangement system according to claim 13, wherein the entry passage has an upper tapered entry portion and the enlarged portion of the opening has a pair of shoulders on opposite sides of the entry passage where it communicates with the enlarged portion of the opening.

15. The metal stud arrangement system according to claim 13, wherein the enlarged portion of the support rail is arrow head shaped in cross-section.

16. The metal stud arrangement system according to claim 13, wherein the enlarged portion of the support rail is circular or oval in cross-section.

17. The metal stud arrangement system according to claim 13, wherein the enlarged portion of the support rail is diamond shaped in cross-section.

* * * * *